United States Patent [19]
Mattox et al.
[11] Patent Number: 4,474,718
[45] Date of Patent: Oct. 2, 1984

[54] METHOD OF FABRICATING NON-LINEAR VOLTAGE LIMITING DEVICE

[75] Inventors: Douglas M. Mattox; Tapan K. Gupta, both of Pittsburgh; William G. Carlson, Murrysville; Shih M. Ho, Pittsburgh, all of Pa.

[73] Assignee: Electric Power Research Institute, Palo Alto, Calif.

[21] Appl. No.: 287,371

[22] Filed: Jul. 27, 1981

[51] Int. Cl.[3] ..... H01B 1/08
[52] U.S. Cl. ..... 264/61; 264/235; 264/346
[58] Field of Search ..... 264/61, 235, 346

[56] References Cited

U.S. PATENT DOCUMENTS

| | | | |
|---|---|---|---|
| 3,925,261 | 12/1975 | Dammler | 264/61 |
| 4,046,847 | 9/1977 | Kresge | 264/61 |
| 4,165,351 | 8/1979 | May | 264/61 |
| 4,180,483 | 12/1979 | Ho | 264/235 |
| 4,254,070 | 3/1981 | Yodogawa et al. | 264/61 |
| 4,272,411 | 6/1981 | Sokoly | 264/61 |
| 4,349,496 | 9/1982 | Levinson | 264/61 |

*Primary Examiner*—James H. Derrington
*Attorney, Agent, or Firm*—Flehr, Hohbach, Test, Albritton & Herbert

[57] ABSTRACT

A non-linear voltage limiting device displaying a particular stability characteristic and designed to eliminate flashover failure across its circumferential edge is disclosed herein along with a specific method of fabrication. The voltage limiting device is characterized by a rising resistive current with time at predetermined temperature and voltage levels and includes a disc-shaped wafer composed primarily of zinc oxide. In accordance with the method disclosed herein, after this wafer is formed and sintered in accordance with prescribed temperature and time requirements, its circumferential edge is provided with an anti-flashover coating which requires curing. Thereafter, the coated wafer is annealed in a way which cures the coating and, at the same time, reduces and preferably minimizes the resistive current rise characteristic referred to above.

4 Claims, 9 Drawing Figures

METHOD OF FABRICATING NON-LINEAR VOLTAGE LIMITING DEVICE

The present invention relates generally to non-linear voltage limiting devices and more particularly to a voltage limiter having specific characteristics and a specific method of fabricating the voltage limiter.

Figure 1A:
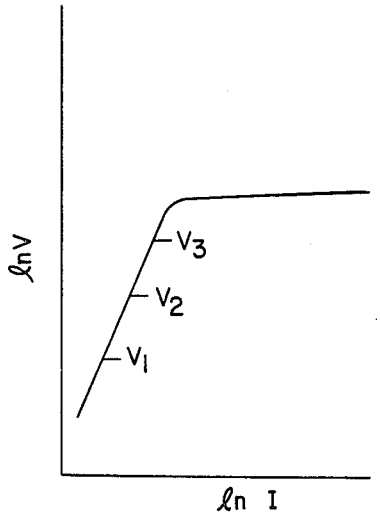
Figure 1B:
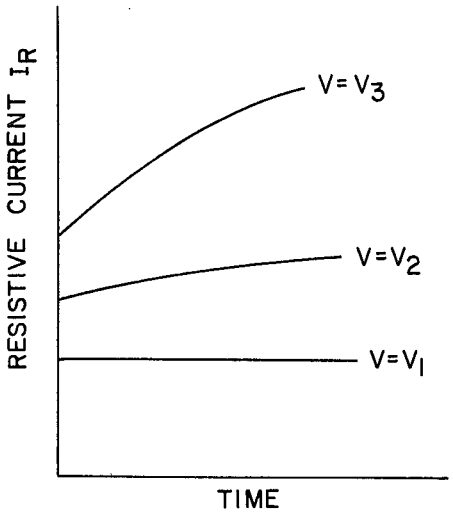

Non-linear voltage limiting devices composed primarily of zinc oxide are well known in the art, as exemplified in U.S. Pat. Nos. 3,570,002 (Masuyama et al); 3,764,556 (Matsouka et al); and 4,045,374 (Nagasawa et al) as well as pending U.S. application Ser. No. 115,448, now abandoned, filed Jan. 25, 1980 and assigned to assignee of the present application. Each of the voltage limiting devices in the patents recited and in the pending application is one which utilizes a sintered disc-shaped wafer composed primarily of zinc oxide. These wafers also include a number of additives, in small amounts, typically bismuth oxide, cobalt oxide, manganese oxide, barium oxide, strontium oxide and lead oxide as well as others. In general, this type of voltage limiting device is characterized by a rise in resistive current with time at predetermined temperature and voltage levels, specifically when the resistive current is measured at the $0.8E_{0.5}$ voltage level of the device and the latter is at a temperature of 100° C. More specifically, when a zinc oxide voltage limiting device or varistor as it is sometimes called is subjected to a steady state 60 Hz AC voltage at a constant temperature, there is sometimes an associated increase in the resistive component of its leakage current with time. This phenomena is accelerated by high operating voltage stresses, so that after prolonged operation of the device, the conditions for thermal run away are eventually met and instability ensues. The problem of isothermal (resistive) current rise with time can be represented by the schematic diagrams illustrated in FIGS. 1A and 1B. FIG. 1A represents the typical current-voltage (IV) characteristic of the device and FIG. 1B represents the typical resistive component of leakage current ($I_R$) vs time (t) at various operating voltages. It can be seen from these schematic diagrams that, as the operating voltage (V1, V2, V3) approaches the knee of the I-V curve, there is a substantial increase in resistive current $I_R$. On the other hand, the margin of safety (protection level) of the associated equipment is greatly improved by operating the device at precisely those voltages which approach the knee of the I-V curve. It is therefore important to provide some means or method of reducing or eliminating the isothermal current rise with time, that is, the resistive current recited above.

In addition to the instability problem discussed above, it has been found that non-linear voltage limiting devices of the type described, especially those which are subjected to high voltages, for example 1200 KV voltage surges, as in lightning arresters, are susceptable to flashover failures at their circumferential edges. One way to avoid this is to provide the circumferential edges of these device with a coating material of higher electrical resistivity than the zinc oxide wafer itself.

In view of the foregoing, it is an object of the present invention to provide a zinc oxide voltage limiting device, that is, one utilizing a wafer composed primarily of zinc oxide, and specifically one which is characterized by at most a small rise in its resistive current with time, as measured at predetermined temperature and voltages levels.

Another object of the present invention is to provide a non-linear voltage limiting device of the type just recited and specifically one which includes a specific anti-flashover collar.

A more particular object of the present invention is to provide a method of fabricating a non-linear voltage limiting device of the general type recited and specifically a method which reduces and preferably minimizes its rise in resistive current with time.

Another particular object of the present invention is to provide a method of fabricating a non-linear voltage limiting device of the general type recited and specifically a method which incorporates the objective just recited with the formation of the previously mentioned anti-flashover collar in an uncomplicated and reliable fashion and without unnecessary method steps.

As will be seen hereinafter, the non-linear voltage limiting device disclosed herein is one which contains zinc oxide as its primary ingredient, as indicated above. This device is fabricated by initially providing the composition, forming it into the desired shape (typically that of a disc having opposite ends and a circumferential edge) and sintering the formed composition in accordance with prescribed temperature and time requirements. Thereafter, the sintered disc is provided with an electrode arrangement at each end.

The various fabrication steps thus far recited are conventional or may be readily provided and, without more, result in a non-linear voltage limiting device which may be characterized by the previously described rise in current with time and suspectibility to flashover failure. However, in accordance with one aspect of the present invention, the sintered composition is annealed, preferably prior to providing its electrodes, in a way which has been found to reduce its rise in resistive current with time over what the rise would otherwise be. In some cases, a rise in resistive current can be entirely eliminated. In an actual working embodiment, the annealing process takes place at relatively high temperatures, specifically between about 400° C. and 800° C. for a prolonged period of time, specifically between 1 and 8 hours.

In accordance with another aspect of the present invention, the non-linear voltage limiting device disclosed herein is provided with a specific anti-flashover collar. Thus, once the composition (which contains zinc oxide as its primary ingredient) is formed into the disc recited above and sintered, an electrical insulation coating which requires curing, preferably one including glass and dispersed alumina particles, is applied to the circumferential edge of the sintered disc. Thereafter, the sintered and coated disc is annealed sufficient to cure the applied coating. In accordance with still another aspect of the present invention, the electrical insulation coating provided is one which can be cured at the same time that the zinc oxide disc is annealed, even at the relatively high and prolonged annealing temperatures utilized, without adversely affecting the intended function of the coating, thus simplifying the overall method of fabrication.

Figure 2:
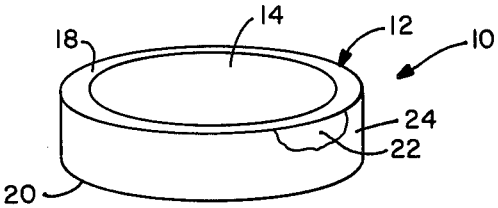
Figure 6:
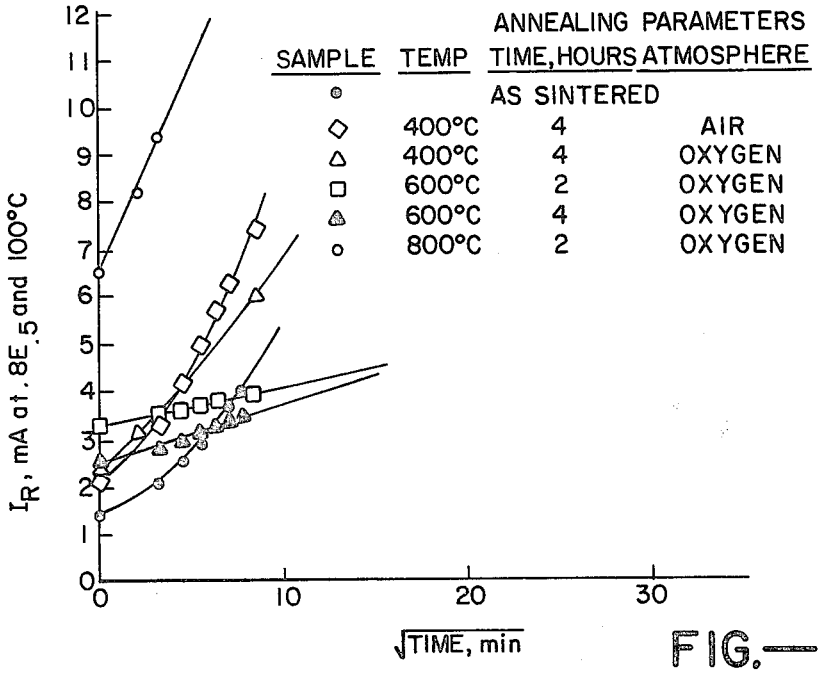
Figure 7:
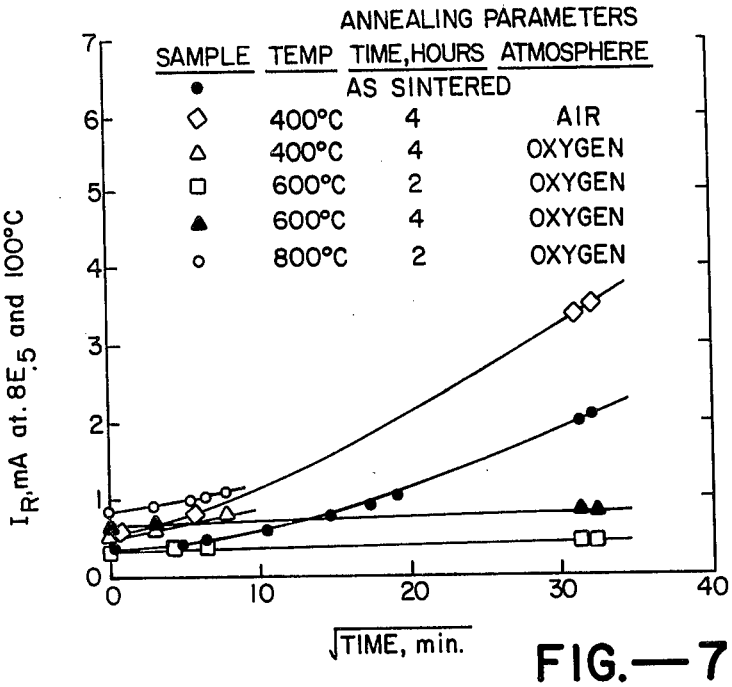
Figure 8:
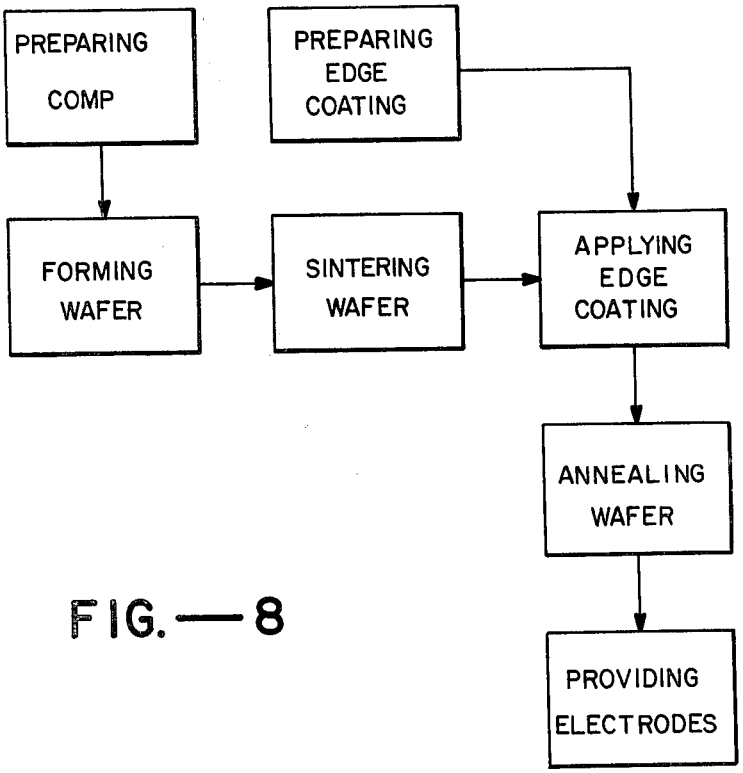

The non-linear voltage limiting device generally described above and its method of fabrication will be discussed in more detail hereinafter in conjunction with the drawings wherein:

FIG. 1A diagrammatically illustrates a typical I-V characterisitc of zinc oxide types of non-linear voltage limiting devices;

FIG. 1B diagrammatically illustrates the $I_R$ vs t curves at various operating voltages of typical zinc oxide types of non-linear voltage limiting devices;

FIG. 2 is perspective view of a non-linear voltage limiting device designed in accordance with the present invention;

FIGS. 3–7 graphically illustrate certain characteristics of certain voltage limiting compositions; and FIG. 8 is a block diagram depicting a method of fabricating the device of FIG. 2 in accordance with the present invention.

Turning now to the drawings, attention is immediately directed to FIG. 2 since FIGS. 1A and 1B were discussed previously. In FIG. 2, there is illustrated a non-linear voltage limiting device 10 which is designed in accordance with the present invention and which serves the various purposes recited in the previously mentioned patents and copending application. For example, as a surge arrester, device 10 serves to protect a power transformer or other such equipment against extraordinarily high voltage surges and current resulting, for example, from an extraordinarily high buildup in energy within an associated transmission line, for example, as high as 1200 KV, or as a result of lightning striking the line. In either case, so long as the voltage across the voltage limiting device is below a predetermined level, for example 1,000 Volts, the device acts as an open circuit. However, should a higher voltage appear across the device, even instantaneously, the device acts as a short circuit to shunt the corresponding surge in current.

As illustrated in FIG. 2, non-linear voltage limiting device 10 includes a sintered body 12 as its active component, that is as its non-linear voltage limiting component, and a pair of electrodes 14 only one of which is shown in FIG. 2. In an actual embodiment, body 12 is formed as a disc-shaped wafer having a relatively flat top side 18, a relatively flat bottom side 20 and a circumferential edge 22 therebetween. The electrodes 14 may be conventional in construction and conventionally applied to the body or wafer 12, specifically to and against its top and bottom sides 18 and 20, respectively.

In addition to voltage limiting wafer 12 and electrodes 14, device 10 is shown in FIG. 2 including a circumferential edge coating 24 disposed over and covering circumferential edge 22 of the wafer. The compositional makeup of this coating and the way in which it is applied to circumferential edge 22 will be discussed hereinafter. For the moment it suffices to say that this coating serves as an anti-flashover collar to prevent flashover failure along the edge of the device as a result of extraordinarily high voltage surges.

The wafer itself is one which may be conventional in compositional makeup and includes zinc oxide as its primary or major constituent or ingredient. It also typically includes a number of additives, for example bismuth oxide ($Bi_2O_3$), cobalt oxide ($Co_3O_4$), manganese oxide ($MnO_2$), antimony oxide ($Sb_2O_3$), and silicon oxide ($SiO_2$). Other possible additives include aluminum oxide ($Al_2O_3$), zirconium oxide ($ZrO_2$) and gallium oxide ($Ga_2O_3$). Examples of different zinc oxide compositions including some or all of these additives may be found in the previously recited patents and co-pending patent application. In an actual and preferred embodiment of the present invention (hereinafter referred to as the "preferred composition"), the compositional makeup of wafer 12 consists essentially of the following ingredient by mole percent:

| | |
|---|---|
| ZnO | 93.395 |
| $Bi_2O_3$ | 3.0 |
| $Sb_2O_3$ | 1.0 |
| $Co_3O_4$ | 1.0 |
| $M_nO_2$ | 1.0 |
| $SiO_2$ | 0.5 |
| $Al_2O_3$ | 0.005 |
| $ZrO_2$ | 0.1 |

The exact compositional makeup of wafer 12 depends upon its intended use and the desired characteristics of the overall non-linear voltage limiting device. Of particular concern here is its rise in resistive current with time at predetermined temperature and voltages levels. More specifically, it has been found that a non-linear voltage limiting device of the general type described above, that is, one containing zinc oxide as its primary or major constituent and including various additives in small amounts, is characterized by a rise in resistive current with time, unless compensated for. One way to reduce this rise in resistive current is by manipulating and properly selecting the constituents making up the wafer. Another way of affecting this characteristic is by varying the sintering parameters of the wafer during formation of the latter. In order to exemplify these various approaches, a starter or base composition is utilized and includes the following ingredients by mole percent:

| | |
|---|---|
| ZnO | 93.5 |
| $Bi_2O_3$ | 3.0 |
| $Sb_2O_3$ | 1.0 |
| $Co_3O_4$ | 1.0 |
| $M_nO_2$ | 1.0 |
| $SiO_2$ | 0.5 |

The base composition just recited was varied in accordance with Table I shown below. This table lists a number of compositions which are identical to the base composition, except for the addition of small amounts of $Al_2O_3$, $ZrO_2$ and /$Ga_2O_3$. These additional oxide additives are provided at the expense of zinc oxide.

TABLE I

| | Oxide Additives Weight % | | |
|---|---|---|---|
| Composition | $Al_2O_3$ | $ZrO_2$ | $Ga_2O_3$ |
| 113 | .005 | 0 | 0 |
| 115 | .02 | 0 | 0 |
| 120 | .05 | 0 | 0 |
| 121 | .10 | 0 | 0 |
| 119 | .005 | .1 | 0 |
| 122 | .02 | .1 | 0 |
| 125 | .02 | .2 | 0 |
| 127 | .10 | .5 | 0 |
| 112 | .0025 | 0 | .0075 |
| 114 | .0065 | 0 | .0195 |
| 116 | 0 | 0 | .015 |
| 117 | 0 | 0 | .0375 |
| 118 | 0 | 0 | .09 |

Figure 3:
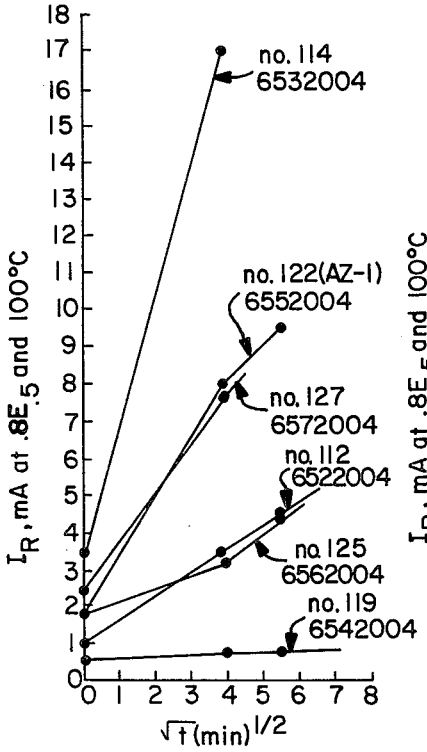
Figure 4:
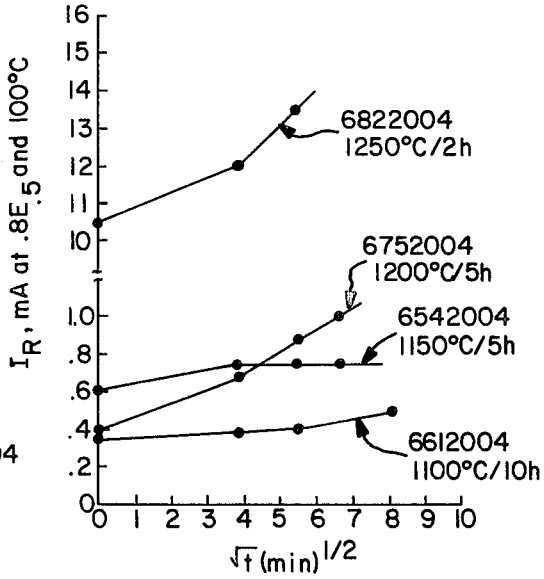

Referring to FIGS. 3 and 4, graphs are illustrated depicting how resistive current ($I_r$) varies with time (its square root for convenience) for various ones of the compositions set forth in Table I. The compositions represented in the graphs of FIG. 3 were sintered at 1150° C. for five hours and subjected to a steady state 60 Hz voltage at 100° C. The compositions represented by the graphs of FIG. 4 (all compositions 119) were sintered in accordance with different prescribed temperature and time requirements, as indicated in the figure. In both cases, resistive current $I_r$ was measured at the 0.8 $E_{0.5}$ voltage level of the sample and at a temperature of 100° C. The voltage level $E_{0.5}$ is the "turn on" voltage of the device measured in V/cm at a current density of $5\times10^{-4}$ A/cm$^2$.

Referring specifically to the graphs of FIG. 3, the only composition that shows reasonable success in stabilizing resistive current rise is the composition 119. Moreover, all of the compositions with high $Al_2O_3$ and/or $Ga_2O_3$ contents display poor resistive current rise stability under these conditions. As indicated above, the graphs of FIG. 4 show the affects of a certain process parameter, specifically sintering parameters, on the resistive current rise characteristics of composition 119. These graphs demonstrate that a lower process temperature for a longer time gives not only a lower resistive current $I_r$ but also improves its stability over time.

In addition to the foregoing, it was discovered that a low temperature post sintering heat treatment, that is, an annealing process is an uncomplicated and yet reliable way of improving resistive current rise stability over time. More specifically, given a sintered non-linear voltage limiting device characterized by a rise in resistive current with time and formed primarily of zinc oxide, it has been found that subjecting such a device to an annealing process in accordance with prescribed temperature and time requirements actually reduces the rise in resistive current of the device with time and, in some cases, eliminates the rise altogether. Using the compositional makeup of composition 119 as the preferred composition for wafer 22, the latter is preferably annealed at a temperature between 400° C. and 800° C., most preferably at about 600° C., for a period of about one hour to eight hours, preferably between one and four hours, in an oxidizing atmosphere, either air or oxygen. This is best exemplified in the graphs of FIGS. 5 and 6.

Figure 5:
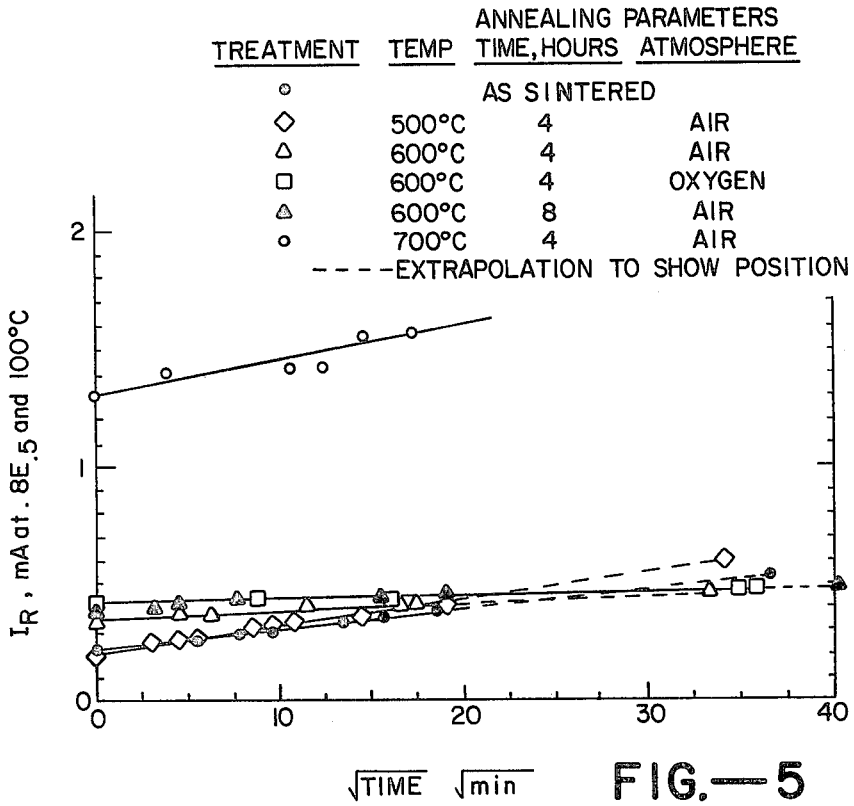

FIG. 5 graphically illustrates the effect of annealing on the resistive current with time of composition 119 when sintered in flowing air at 1100° C. for ten hours. As in the previous graphs, the resistive current in the graphs of FIG. 4 were taken at the $0.8E_{0.5}$ voltage level of the composition at a measuring temperature of 100° C. Note that the composition was evaluated without annealing (as sintered) as a control (see also FIGS. 3 and 4) and in accordance with five different annealing procedures. In FIG. 6, the effects of annealing on the resistive current rise stability of composition 122 sintered in flowing air at 1200° C. for two hours is illustrated. Again, a control is provided as well as five examples of different annealing procedures. FIG. 7 displays graphically the effects of annealing on the resistive current rise of composition 119 as sintered for two hours at 1200° C.

From the graphic illustrations in FIGS. 5, 6 and 7, it should be apparent that the preferred compositional makeup for wafer 12 in overall device 10 is composition 119. The preferred sintered temperature and time is 1100° C. for ten hours, although this may vary and will quite possibly vary with variations in the composition. The preferred annealing temperature is 600° C. in either air or oxygen and the annealing time is between one and eight hours.

Having described overall voltage limiting device 10, with the exception of edge coating 24, attention is now directed to FIG. 8 which by means of block diagram illustrates the preferred way in which the device is fabricated. As indicated in this figure, the compositional makeup of wafer 12 is initially prepared and formed into the disc-shaped wafer illustrated in FIG. 2. This can be readily carried out by those with ordinary skill in the art to which the present invention pertains and requires no further discussion. Once the wafer is formed, it is sintered, again conventionally. As will be seen hereinafter, the edge coating 24 is prepared and applied onto circumferential edge 22 of the wafer at this time, as will be discussed hereinafter. Once the edge coating is applied or if one is not used, the sintered wafer is thereafter annealed in the manner described above. Thereafter, as indicated in FIG. 8, the electrodes 14 and 16 are provided. Typically, these electrodes consist of metalized coatings, usually zinc, only the top one of which is indicated in FIG. 2. Inasmuch as this type of material is incapable of withstanding the extreme annealing temperatures recited above for the prolonged annealing periods, the electrodes are provided after this step.

Returning now to FIG. 2 in conjunction with FIG. 8, attention is directed specifically to edge coating 24. As stated above, this coating serves as an anti-flashover collar. In one preferred embodiment of the present invention, this coating is composed primarily of glass containing extraordinarily fine particle size alumina. More specifically, in one specific embodiment, a glass slurry developed by mixing several organic compounds with a powder admixture of low melting temperature glass and fine particle size alumina (preferably 2 to 20 grams), has been found to be suitable for forming the coating. In the slurry, the glass and alumina powders must be uniformly suspended for a long period of time, allowing the application of the slurry onto the sintered wafers. The addition of extraordinarily fine particle size alumina has been found unique in this regard. More specifically, it functions to increase the refractoriness and electrical resistivity of the coating, it decreases thermal expansion of the coating and it optimizes the firing temperature of the coating. The materials and compositions used in forming one specific coating slurry are as follows:

| | |
|---|---|
| Corning 7570 glass powder (320 mesh) | 150 grams |
| Linde A alumina (about 0.3 micrometers) | 4.5 grams |
| Castung oil (Baker Castor Oil Co.) | 1.5 |
| 4GO (Triethylene glycol nexoate, Union Carbide Corp.) | 8.0 gr |
| B-76 (Polyvinyl butyral, Monsanto Co.) | 5.0 gr |
| Trixcin (Baker Castor Oil Co.) | 0.25 gr |
| Trimeth (methanol + trichloroethyle, Fisher Scientific) | 70 gr |

The above-recited materials and compositions were recited by their tradenames. These same materials and compositions correspond to the following generic materials and compositions:

| | |
|---|---|
| Glass powder (320 mesh) | 150 grams |
| Alumina (about 0.3 micrometers) | 2–20 grams |
| Dehydrated Castor oil | 1.5 grams |
| Triethylene glycol hexoate | 8.0 grams |
| Polyvinyl butyral | 5.0 grams |
| Trihydroxystearin | 0.25 grams |
| A mixture of methanol + trichloroethylene | 70 grams |

In accordance with one procedure of making the slurry just recited, the glass and alumina are first combined into a well mixed powder mixture and this mixture is mixed in a ball mill together with the other organic components for 24 hours. Thereafter, this combined mixture is combined with water to form a relatively thick slurry. The slurry is either painted or sprayed onto the circumferential edge of its associated wafer to form a coating which is cured at about 600° C. for between about one and two hours. The coating is preferably brought to its peak temperature from room temperature in about one hour and thereafter allowed to cool in its furnace. In a specific procedure heretofore provided the coating was subjected to the following curing steps:

1. Room temperature to 100° C. within 10 minutes (of application) and hold at 100° C. for 10 minutes.
2. 100° C. to 500° C. at 40° C./minute.
3. Hold at 500° C. for 10 minutes.
4. 500° C. to 600° C. within 5 minutes.
5. 600° C. for periods of 5 to 120 minutes.
6. Cooling in the closed furnace.

After a coating of the type just described is cured it presents itself as a thin, shiny and homogeneous coating without any cracking. The properties of the coating have been found to be similar to the basic characteristics of the glass used in the slurry which are listed below:

| | |
|---|---|
| Thermal Expansion | $9.2 \times 10^{-6}$ in/in/°C. |
| Working point | 560° C. |
| Softening point | 440° C. |
| Volume resistivity (250° C.) | $10^{10.6}$ ohm-cm |
| Volume resistivity (350° C.) | $10^{8.7}$ ohm-cm |

From the curing requirement recited directly above, it should be quite apparent that the particular coating described is compatible with the preferred annealing procedure described above.

As indicated in FIG. 8, once the coating just recited is prepared it is applied to the circumferential edge 22 of sintered wafer 12 before the latter is annealed. This particular coating can be cured at a temperature of about 600° C. for one to two hours which is well within the preferred annealing range described above. Hence, the annealing step serves both to reduce the rise in resistitive current with time of the sintered wafer and as a means of curing edge coating 24.

What is claimed is:

1. A method of fabricating a non-linear voltage limiter of the type characterized by a rise in resistive current with time when said current is measured at the $0.8E_{0.5}$ voltage level of said limiter at a temperature of 100° C., said method comprising the steps of:

providing a composition consisting essentially of the following ingredients by mole %

| | |
|---|---|
| ZnO | 93.395 |
| $Bi_2O_3$ | 3.0 |
| $Sb_2O_3$ | 1.0 |
| $Co_3O_4$ | 1.0 |
| $M_nO_2$ | 1.0 |

-continued

| | |
|---|---|
| $SiO_2$ | 1.0 |
| $Al_2O_3$ | 0.005 |
| $ZrO_2$ | 0.1; |

forming said composition into a wafer having the shape of a disc including opposite ends, a circumferential edge therebetween, and electrode means on opposite ends of the wafer;

sintering said formed composition in accordance with prescribed temperature and time requirements;

annealing said sintered composition at about 600° C. for between about one and eight hours in an oxidizing atmosphere; and providing an electrical insulation coating which can be cured if subjected to said annealing step without degradation of its electrical insulation characteristics and applying said coating over and against the circumferential edge of said composition after the latter is sintered but before it is annealed, said annealing step being sufficient to cure said coating, said coating consisting essentially of the following ingredients in grams:

| | |
|---|---|
| Glass powder (320 mesh) | 150 |
| Alumina (about 0.3 micrometers) | 2–20 |
| Dehydrated Castor Oil | 1.5 |
| Triethylene glycol hexoate | 8.0 |
| Polyvinyl butyral | 5.0 |
| Trihydroxystearin | 0.25 |
| A mixture of methanol + trichloroethylene | 70. |

2. A method of fabricating a non-linear voltage limiter comprising the steps providing a composition containing zinc oxide as its primary ingredient, forming said composition into a disc-shaped wafer having opposite ends and a circumferential edge therebetween, sintering said formed compostion in accordance with prescribed temperature and time requirements, providing an electrical insulation coating which requires curing and which can be cured at a relatively low temperature of about 600° C. without degrading its electrical insulation characteristics, said coating including glass as its primary ingredient and alumina particles dispersed throughout said glass, applying said coating over and against the circumferential edge of said sintered wafer and thereafter annealing said sintered and coated wafer at a temperature of about 600° C.

3. A method according to claim 2 wherein said voltage limiter is of the type characterized by a rise in resistive current with time at a predetermined temperature and voltage and wherein said sintered and coated wafer is annealed in a way which reduces said rise in resistive current with time over what said rise would otherwise be.

4. A method according to claim 2 wherein said wafer is annealed for between one and two hours.

* * * * *